US006302081B1

(12) United States Patent
Moser et al.

(10) Patent No.: US 6,302,081 B1
(45) Date of Patent: Oct. 16, 2001

(54) METHOD FOR OPERATING AN INTERNAL COMBUSTION ENGINE

(75) Inventors: Winfried Moser, Ludwigsburg; Matthias Philipp, Vaihingen/Enz; Dirk Mentgen, Schweiberdingen; Michael Oder, Illingen; Georg Mallebrein, Korntal-Muenchingen; Christian Koehler, Erligheim; Juergen Foerster, Ingersheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/424,584

(22) PCT Filed: Mar. 24, 1999

(86) PCT No.: PCT/DE99/00872

§ 371 Date: Mar. 2, 2000

§ 102(e) Date: Mar. 2, 2000

(87) PCT Pub. No.: WO99/49200

PCT Pub. Date: Sep. 30, 1999

(30) Foreign Application Priority Data

Mar. 26, 1998 (DE) ..... 198 13 378

(51) Int. Cl.[7] ..... F02B 17/00
(52) U.S. Cl. ..... 123/295; 123/436
(58) Field of Search ..... 123/295, 305, 123/436

(56) References Cited

U.S. PATENT DOCUMENTS 5,331,933 * 7/1994 Matsushita et al. ..... 123/295
5,722,362 * 3/1998 Takano et al. ..... 123/295
5,881,693 * 3/1999 Mizuno ..... 123/295
5,896,840 * 4/1999 Takahashi ..... 123/295
5,960,769 * 10/1999 Mashiki et al. ..... 123/295
5,975,048 * 11/1999 Sivashankar et al. ..... 123/295
6,006,717 * 12/1999 Suzuki et al. ..... 123/295
6,019,082 * 2/2000 Mashiki et al. ..... 123/295

FOREIGN PATENT DOCUMENTS 196 31 986 2/1998 (DE) .
0 826 880 3/1998 (EP) .
0 849 458 6/1998 (EP) .

* cited by examiner

*Primary Examiner*—Erik Solis
(74) *Attorney, Agent, or Firm*—Kenyon & Kenyon

(57) ABSTRACT

An internal combustion engine, in particular for a motor vehicle, is described. The internal combustion engine is equipped with an injection valve with which fuel can be injected directly into a combustion chamber either, in a first operating mode, during a compression phase or, in a second operating mode, during an intake phase. Also provided is a control device for switching between the two operating modes and for differing open-loop and/or closed-loop control, in the two operating modes, of the operating variables influencing the actual torque of the internal combustion engine as a function of a reference torque. A change in the actual torque during a switchover is operation is detected by the control device and as a function thereof, at least one of the operating variables is influenced by the control device.

17 Claims, 6 Drawing Sheets

METHOD FOR OPERATING AN INTERNAL COMBUSTION ENGINE

FIELD OF THE INVENTION

The present invention relates to a method for operating an internal combustion engine, in particular of a motor vehicle, in which fuel is injected directly into a combustion chamber either, in a first operating mode, during a compression phase or, in a second operating mode, during an intake phase; in which switching between the two operating modes occurs; and in which the operating variables influencing the actual torque of the internal combustion engine are controlled in open-loop and/or closed-loop fashion, as a function of a reference torque, differently in the two operating modes. The present invention further relates to an internal combustion engine, in particular for a motor vehicle, having an injection valve with which fuel can be injected directly into a combustion chamber either, in a first operating mode, during a compression phase or, in a second operating mode, during an intake phase; and having a control device for switching between the two operating modes and for differing open-loop and/or closed-loop control, in the two operating modes, of the operating variables influencing the actual torque of the internal combustion engine as a function of a reference torque.

BACKGROUND INFORMATION

Existing systems for directly injecting fuel into the combustion chamber of an internal combustion chamber switch between a first operating mode and a second operating mode.

A distinction is made in this context between a so-called stratified mode as a first operating mode, and a so-called homogeneous mode as a second operating mode. Stratified mode is used in particular at lesser loads, while homogeneous mode is utilized when greater loads are applied to the internal combustion engine.

In stratified mode, fuel is injected into the combustion chamber during the compression phase of the internal combustion engine, in such a way that at the moment of ignition, a fuel cloud is located in the immediate vicinity of a spark plug. This injection event can be accomplished in different ways. For example, it is possible for the injected fuel cloud already to be present at the spark plug during or immediately after the injection event, and to be ignited by it. It is also possible for the injected fuel cloud to be guided to the spark plug by a charging movement, and only then ignited. With both combustion methods, what is present is not a uniform fuel distribution but rather a stratified charge.

The advantage of the stratified mode is that in it, the lesser loads that are being applied can be handled by the internal combustion engine with a very small quantity of fuel. Greater loads, however, cannot be handled with the stratified mode.

In the homogeneous mode provided for such greater loads, fuel is injected during the intake phase of the internal combustion engine, so that the fuel can readily experience turbulence and thus be distributed in the combustion chamber. In this respect, homogeneous mode corresponds approximately to the method of operation of internal combustion engines in which fuel is injected in conventional fashion into the intake duct. If necessary, homogeneous mode can also be used at lesser loads.

In stratified mode, the throttle valve in the intake duct leading to the combustion chamber is opened wide, and combustion is controlled in open-loop and/or closed-loop fashion only by way of the fuel mass that is to be injected. In homogeneous mode, the throttle valve is opened or closed as a function of the requested torque, and the fuel mass to be injected is controlled in open-loop and/or closed-loop fashion as a function of the aspirated air mass.

In both operating modes, i.e., in stratified mode and in homogeneous mode, the fuel mass to be injected is additionally controlled in open-loop and/or closed-loop fashion, by a plurality of further operating variables, to a value that is optimum in terms of fuel economy, exhaust emissions reduction, and the like. The open-loop and/or closed-loop control is different in the two operating modes.

It is necessary to switch the internal combustion engine over from stratified mode to homogeneous mode and back again. Whereas in stratified mode the throttle valve is opened wide and air is thus supplied largely unthrottled, in homogeneous mode the throttle valve is only partially open and thus reduces the supply of air. Especially when switching over from stratified mode into homogeneous mode, the ability of the intake duct leading to the combustion chamber to store air must be taken into consideration. If it is not taken into account, the switchover can result in an increase in the torque delivered by the internal combustion engine.

SUMMARY

It is an object of the present invention to create a method for operating an internal combustion engine with which improved switching between the operating modes is possible.

This object is achieved according to the present invention in that a change in the actual torque during a switchover operation is detected; and that as a function thereof, at least one of the operating variables is influenced.

Based on the determination of changes in the actual torque during the switchover operation, it is possible to detect roughness or jerking during the switchover. Once jerking has been detected, the roughness can be counteracted by influencing operating variables. It is thereby globally possible to avoid roughness or jerking during the switchover from homogeneous operation to stratified operation or vice versa. The switchover operations between the two operating modes are thus improved, in particular, in terms of enhanced smoothness and thus enhanced comfort.

In an advantageous embodiment of the present invention, the actual torque is determined before and after a switchover operation. This represents a particularly easy possibility for sensing the change in the actual torque.

In an advantageous embodiment of the present invention, the change in the actual torque is detected as a function of the sensed rotation speed of the internal combustion engine. The result is that any change in the actual torque and thus any jerking or the like can be detected with the aid of the rotation speed sensor that is already present. Additional sensors or other additional components are thus not necessary.

In an advantageous embodiment of the present invention, roughness values are determined for the individual cylinders. From these roughness values, conclusions can be drawn as to changes in the actual torque of the internal combustion engine. Using the roughness values, it is thus possible to detect speed fluctuations or jerking of the internal combustion engine. The roughness values can be determined in various ways. For example, it is possible to provide a roughness sensor to measure the roughness values. The roughness values can also, for example, be derived from the rotation speed of the internal combustion engine. The roughness values represent an indication of torque differences between successive cylinders.

In an advantageous embodiment of the present invention, at least one of the operating variables influencing the actual torque is changed in both operating modes at a mutually corresponding operating point of the internal combustion engine, and at least one of the roughness values of the first operating mode is then compared to at least one of the roughness values of the second operating mode. The internal combustion engine is thus exposed to a change in each of the two operating modes.

The consequence of that change is determined in the form of a change in the roughness values. From that change in the roughness values, conclusions can be drawn as to possible torque differences between the two operating modes. Potential jerking upon switchover between the two operating modes can thus be detected in advance and prevented.

It is particularly advantageous if the operating variable is changed in cylinder-specific fashion in such a way that the delivered torque of successive cylinders changes, but the total torque of all the cylinders remains the same. The changes are thus performed in cylinder-specific fashion. The result is that the total torque of all the cylinders can be kept approximately constant. Differences in delivered torque do occur, however, between the cylinders, and can be utilized to detect potential rotation speed fluctuations during switchover between the two operating modes.

It is moreover particularly advantageous if the torque delivered by one of the cylinders is reduced, and if the torques delivered by the other cylinders are increased proportionally. The result is that the total torque remains approximately constant, and thus that no loss of comfort or the like is experienced by the user.

In an advantageous embodiment of the present invention, a roughness value is determined in each of the two operating modes, and the values are then compared to one another. It is particularly advantageous in this context if a torque difference is determined from the comparison of the two roughness values. This torque difference represents a static switchover jerk that is counteracted, in the direction of minimization, by a corresponding influence on the operating variables of the internal combustion engine.

In an advantageous embodiment of the present invention, the operating variables of the internal combustion engine are influenced as a function of the comparison. It is possible, for example, in the event a deviation is noted between the roughness values of the first operating mode and the roughness values of the second operating mode, to influence operating variables of the internal combustion engine in such a way that that deviation is minimized or reduced to zero. Any potential jerking upon switchover between the two operating modes can thus be minimized or indeed reduced to zero.

In an advantageous embodiment, the influence on one of the operating variables is exerted adaptively. A permanent correction of the switchover operation is thus accomplished. It is thereby possible to compensate, for example, for changes in the internal combustion engine over its operating lifetime, in particular for wear phenomena and the like. It is also possible to compensate, upon initial startup, for discrepancies between different internal combustion engines of the same type.

It is particularly advantageous if the calculation models of the two operating modes are adaptively adjusted to one another. This can be done in addition or alternatively to the adaptive influencing of operating variables of the internal combustion engine. The result of this feature is that the static switchover pressure is reduced.

In a further advantageous embodiment of the present invention, the influence on one of the operating variables is not exerted until the next switchover operation. The result is that the calculations according to the present invention can be performed between two switchover operations, so that sufficient time is available for them.

It is particularly advantageous if, in the first operating mode, the injected fuel mass is influenced in particular in the direction of an increase. It is also advantageous if, in the second operating mode, the ignition angle or ignition time is influenced in particular in the direction of retarding. These features make it possible, in the event any roughness is detected during the switchover operation, to influence the actual torque of the internal combustion engine and thus to decrease the roughness. A particular result of these features is to bring the two operating modes closer to one another at the moment of switchover.

It is of particular significance that the method according to the present invention is carried out via a control element that is provided for a control device of an internal combustion engine, in particular of a motor vehicle. In this context, a program that can execute on a calculation device, in particular on a microprocessor, and is suitable for performing the method according to the present invention, is stored on the control element. In this instance, therefore, the present invention is carried out by way of a program stored on the control element, so that this control element equipped with the program represents the present invention in the same way as does the method for whose execution the program is suitable. An electrical storage medium, for example a read-only memory, can be used, in particular, as the control element.

DETAILED DESCRIPTION

Figure 1:
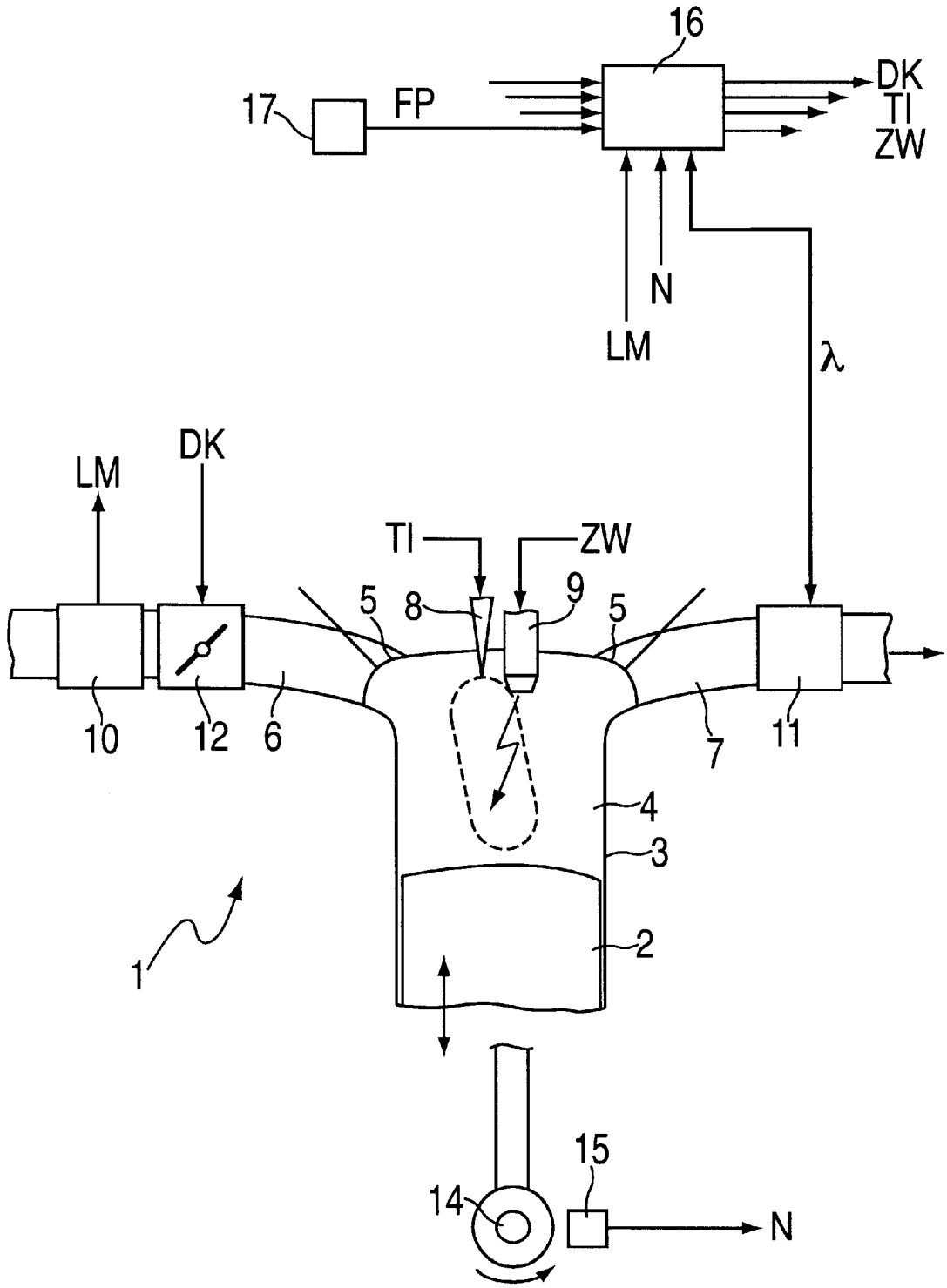
FIG. 1 shows a schematic block diagram of an exemplary embodiment of an internal combustion engine, according to the present invention, of a motor vehicle.

FIG. 1 depicts an internal combustion engine 1 in which a piston 2 is movable back and forth in a cylinder 3. Cylinder 3 is equipped with a combustion chamber 4 to which an intake duct 6 and an exhaust duct 7 are connected via valves 5. Also associated with combustion chamber 4 are an injection valve 8 that can be activated with a signal TI, and a spark plug 9 that can be activated with a signal ZW.

Intake duct 6 is equipped with an air mass sensor 10, and exhaust duct 7 can be equipped with a lambda sensor 11. Air mass sensor 10 measure the air mass of the fresh air supplied to intake duct 6, and generates a signal LM as a function thereof. Lambda sensor 11 measures the oxygen content of the exhaust gas in exhaust duct 7, and generates a signal λ as a function thereof.

A throttle valve 12, whose rotational position is adjustable by way of a signal DK, is housed in intake duct 6.

In a first operating mode—stratified mode—of internal combustion engine 1, throttle valve 12 is opened wide. Fuel is injected by injection valve 8, during a compression phase brought about by piston 2, into combustion chamber 4, locally into the immediate vicinity of spark plug 9, and temporally at a suitable interval before the moment of ignition. The fuel is then ignited with the aid of spark plug 9, so that in the working phase that then follows, piston 2 is driven by the expansion of the ignited fuel.

In a second operating mode—homogeneous mode—of internal combustion engine 1, throttle valve 12 is partially opened or closed as a function of the desired supplied air mass. Fuel is injected by injection valve 8, during an intake phase brought about by piston 2, into combustion chamber 4. As a result of the air drawn in simultaneously, the injected fuel becomes turbulent and is thus distributed substantially uniformly in combustion chamber 4. The fuel/air mixture is then compressed during the compression phase and is then ignited by spark plug 9. Piston 2 is driven by the expansion of the ignited fuel.

In both stratified mode and homogeneous mode, the driven piston imparts to a crankshaft 14 a rotary motion with which ultimately the wheels of the motor vehicle are driven. Associated with crankshaft 14 is a rotation speed sensor 15 that generates a signal N as a function of the rotary motion of crankshaft 14.

The fuel mass injected by injection valve 8 into combustion chamber 4, in stratified mode and in homogeneous mode, is controlled in open-loop and/or closed-loop fashion by a control device 16, in particular in terms of low fuel consumption and/or low pollutant generation. For that purpose, control device 16 is equipped with a microprocessor that has stored in a storage medium, in particular in a read-only memory, a program that is suitable for performing the aforesaid open-loop and/or closed-loop control.

Control device 16 is acted upon by input signals that represent operating variables, measured by sensors, of the internal combustion engine. Control device 16 is connected, for example, to air mass sensor 10, lambda sensor 11, and rotation speed sensor 15. Control device 16 is also connected 18 to an accelerator pedal sensor 17 which generates a signal FP that indicates the position of an accelerator pedal actuable by a driver, and thus the torque requested by the driver. Control device 16 generates output signals with which the behavior of the internal combustion engine can be influenced, via actuators, in accordance with the desired open-loop and/or closed-loop control system. For example, control device 16 is connected to injection valve 8, spark plug 9, and throttle valve 12, and generates signals TI, ZW, and DK necessary for their activation.

Control device 16 performs the method described below with reference to FIGS. 2 and 3 for switching over from a stratified mode into a homogeneous mode. The blocks shown in FIG. 2 represent functions of the method that are implemented, for example in the form of software modules or the like, in control device 16.

Figure 2:
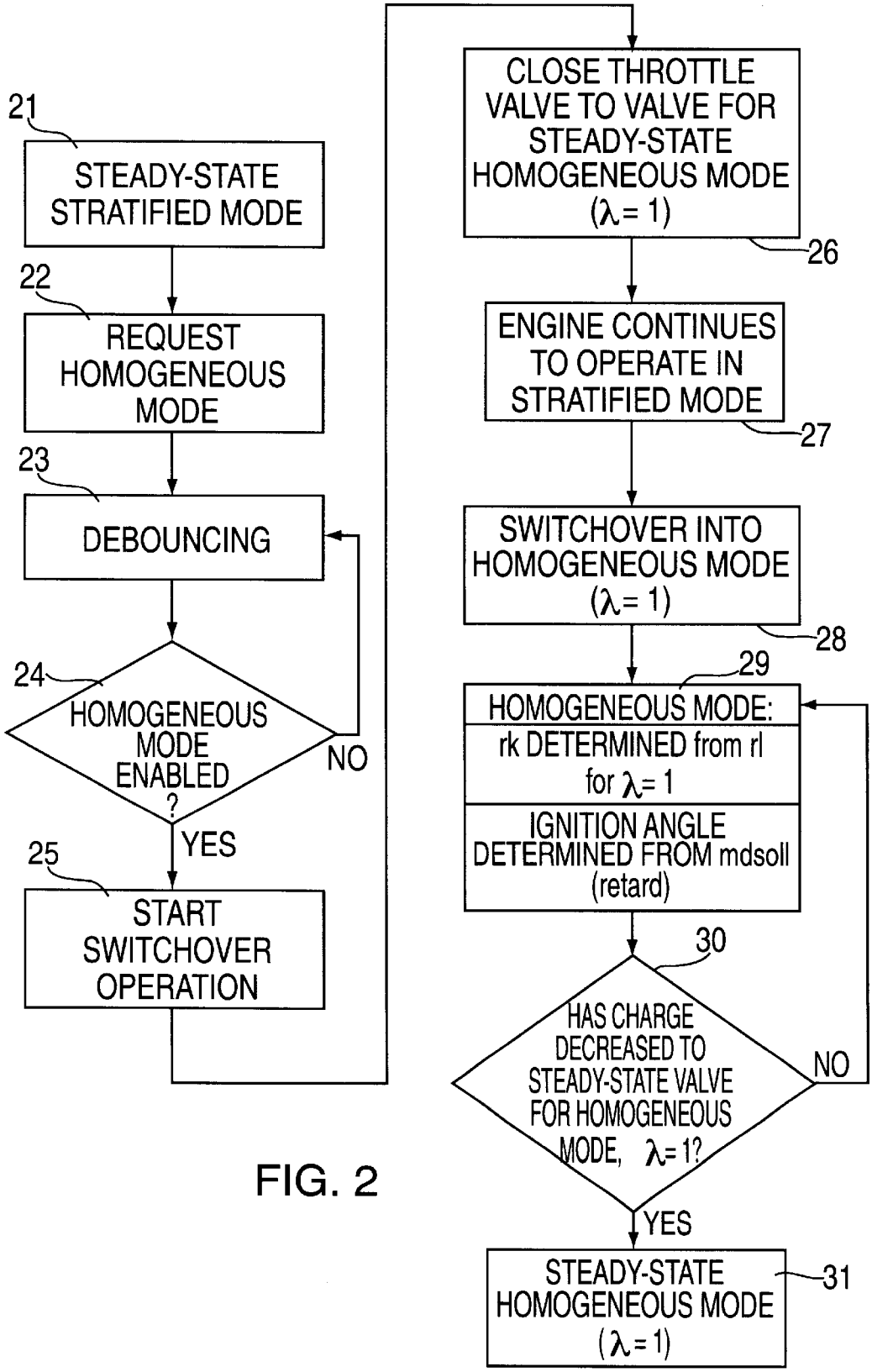
FIG. 2 shows a schematic flow chart of an exemplary embodiment of a method according to the present invention for operating the internal combustion engine of FIG. 1.

In FIG. 2, it is assumed in a block 21 that internal combustion engine 1 is in a steady-state stratified mode. In a block 22, a transition into a homogeneous mode is then requested, for example because the driver wishes the motor vehicle to accelerate. The time at which the request for homogeneous mode is made is also evident from FIG. 3.

A debouncing function, with which switching back and forth in quick succession between stratified and homogeneous mode is prevented, is then accomplished by way of blocks 23, 24. When homogeneous mode is enabled, the transition from stratified mode to homogeneous mode is started by a block 25. The time at which the switchover operation begins is labeled in FIG. 3 with the reference character 40.

At the aforesaid time 40, throttle valve 12 is controlled by way of a block 26 out of its state wdksch which is completely open in stratified mode into an at least partially opened or closed state wdkhom for homogeneous mode. The rotational position of throttle valve 12 in homogeneous mode is directed in particular toward a stoichiometric fuel/air mixture, i.e. $\lambda=1$, and depends moreover on, for example, the torque demanded and/or the rotation speed N of internal combustion engine 1 and the like. It is also possible, however, to make the fuel/air mixture rich or lean, i.e. to select $\lambda<1$ or $\lambda>1$.

Adjustment of throttle valve 12 causes internal combustion engine 1 to transition from the steady-state stratified mode into a non-steady-state stratified mode. In this operating state, the air mass supplied to combustion chamber 4 slowly decreases from a charge rlsch during stratified mode to smaller charges. This is evident from FIG. 3. The air mass supplied to combustion chamber 4, or its charge, is ascertained in this context by control device 16 from, inter alia, signal LM of air mass sensor 10. According to a block 27, internal combustion engine 1 continues to operate in stratified mode.

A switchover then occurs, by way of a block 28 of FIG. 2, into a non-steady-state homogeneous mode. This occurs at a time 41 in FIG. 3.

According to a block 29, in homogeneous mode the fuel mass rk injected into combustion chamber 4 is controlled in open-loop and/or closed-loop fashion, as a function of the air mass rl supplied to combustion chamber 4, in such a way that, in particular, a stoichiometric fuel/air mixture results, i.e. that $\lambda=1$. It is also possible, however, to adjust the fuel/air mixture within a range $0.7<\lambda<1.5$.

The result of influencing fuel mass rk in this fashion is that at least for a certain period of time—the torque Md delivered by internal combustion engine 1 would rise. This is compensated for by the fact that at time 41, i.e., as the switchover to homogeneous mode occurs, ignition angle ZW is adjusted, starting from a value zwsch, in such a way that the delivered torque Md conforms to a reference torque mdsoll resulting from, inter alia, the requested torque, and thus remains approximately constant.

For that purpose, fuel mass rk is determined from air mass rl supplied to combustion chamber 4, using the assumption of a stoichiometric fuel/air mixture. Ignition angle ZW is additionally adjusted as a function of reference torque mdsoll in the direction of retarded ignition. With regard to this retarding, there thus still exists a certain deviation from normal homogeneous mode with which the temporarily excessive supplied air mass, and the resulting excessive generated torque of internal combustion engine 1, are nullified.

In a block 30, a check is made as to whether air mass rl supplied to combustion chamber 4 has finally dropped to the charge that pertains to steady-state homogeneous mode at a stoichiometric fuel/air mixture. If such is not yet the case, then a further waiting time is implemented in a loop via block 29. If such is the case, however, then internal combustion engine 1 proceeds to operate in steady-state homogeneous mode without any ignition timing adjustment by way of block 31. In FIG. 3, this is the case at a time labeled with the reference number 42.

In this steady-state homogeneous mode, the air mass supplied to combustion chamber 4 corresponds to charge rlhom for homogeneous mode, and ignition angle zwhom for spark plug 9 also corresponds to that for homogeneous mode. The same is correspondingly true for rotational position wdkhom of throttle valve 12.

Figure 3:
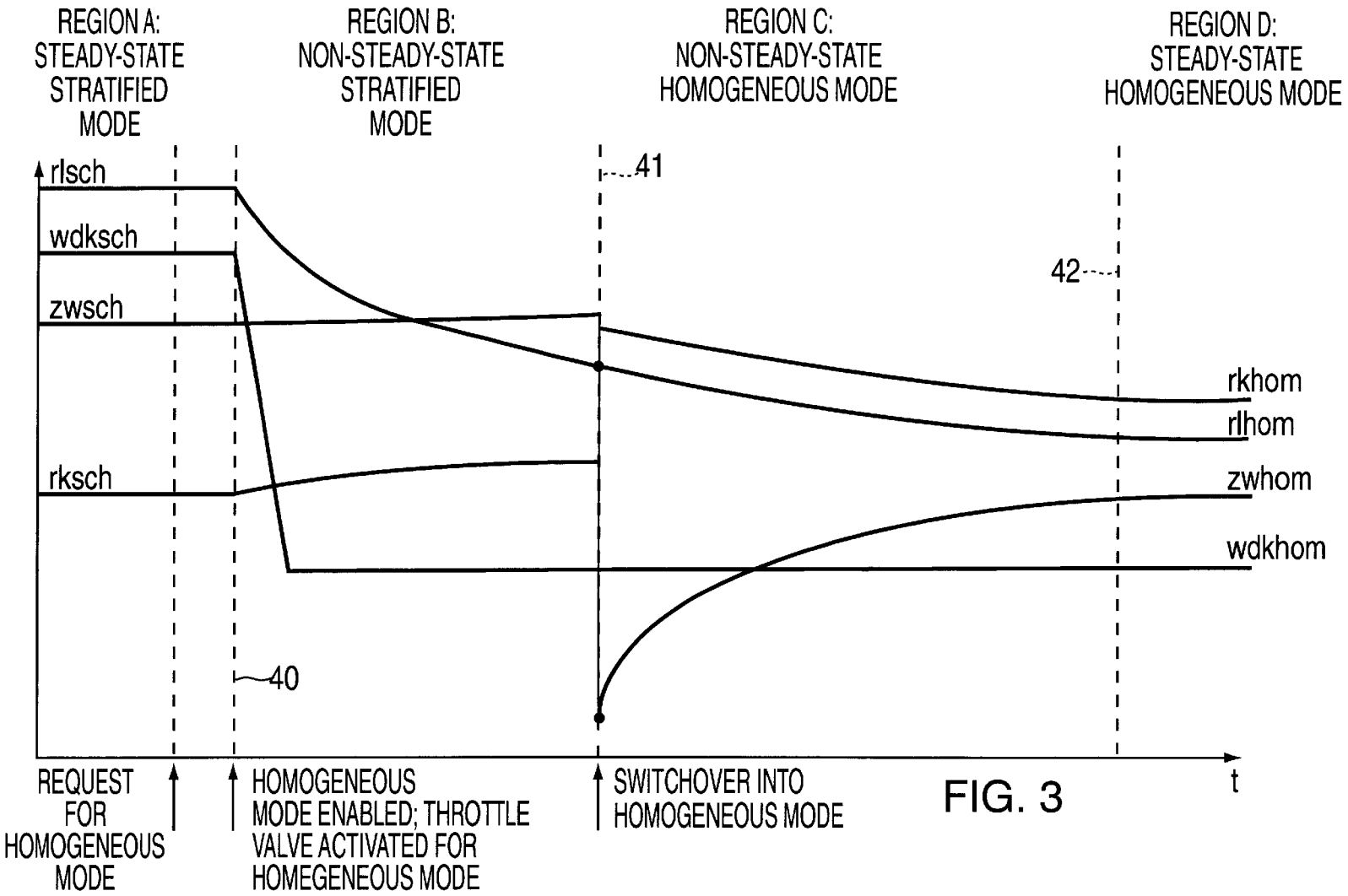
FIG. 3 shows a schematic time diagram of signals of the internal combustion engine of FIG. 1 when performing the method according to FIG. 2.

In FIG. 3, steady-state stratified mode is labeled region A, non-steady-state stratified mode region B, non-steady-state homogeneous mode region C, and steady-state homogeneous mode region D.

Figure 4:
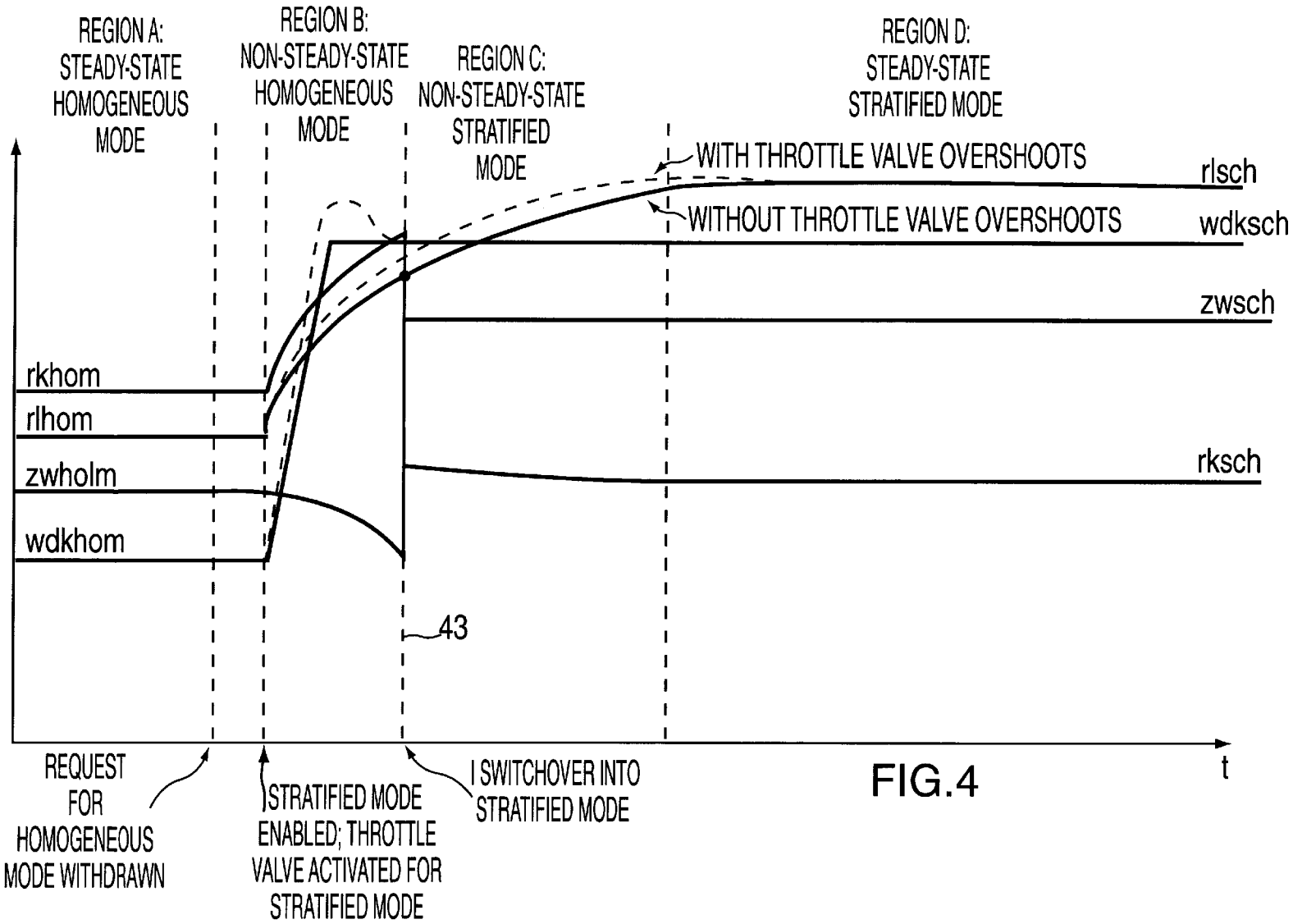
FIG. 4 shows a schematic time diagram of signals of the internal combustion engine of FIG. 1 when performing a method in the opposite direction from the method of FIG. 2.

FIG. 4 depicts a switchover from a homogeneous mode into a stratified mode, proceeding from a steady-state homogeneous mode in which, for example because of the operating variables of internal combustion engine 1, a transition is to be made into a steady-state stratified mode.

The switchover into stratified mode is initiated by control device 16 by the fact that the request for homogeneous mode is withdrawn. After debouncing, the switchover into stratified mode is enabled, and throttle valve 12 is controlled into the rotational position provided for stratified mode. This is a rotational position in which throttle valve 12 is largely opened. This is represented by the transition from wdkhom to wdksch in FIG. 4.

It is possible in this context for this transition to be processed by control device 16 with or without consideration of a throttle valve overshoot. This is represented in FIG. 4 by dashed or solid lines.

The consequence of opening throttle valve 12 is that air mass rl supplied to combustion chamber 4 increases. This is evident in FIG. 4 from the profile of rlhom. Then, the switchover occurs from non-steady-state homogeneous mode (already described) into a non-steady-state stratified mode. This is the case at time 43 in FIG. 4.

Prior to the switchover into stratified mode, the increase in the air mass supplied to combustion chamber 4 is compensated for by the fact that the injected fuel mass rk is increased, and ignition angle ZW is retarded. This is evident in FIG. 4 from the profiles of rkhom and zwhom.

After the switchover into stratified mode, the injected fuel mass rk is set to the value rksch for stratified mode. The same is true for ignition angle ZW, which is set to the value zwsch for stratified mode.

In FIG. 4, steady-state homogeneous mode is labeled region A, non-steady-state homogeneous mode region B, non-steady-state stratified mode region C, and steady-state stratified mode region D.

Figure 5:
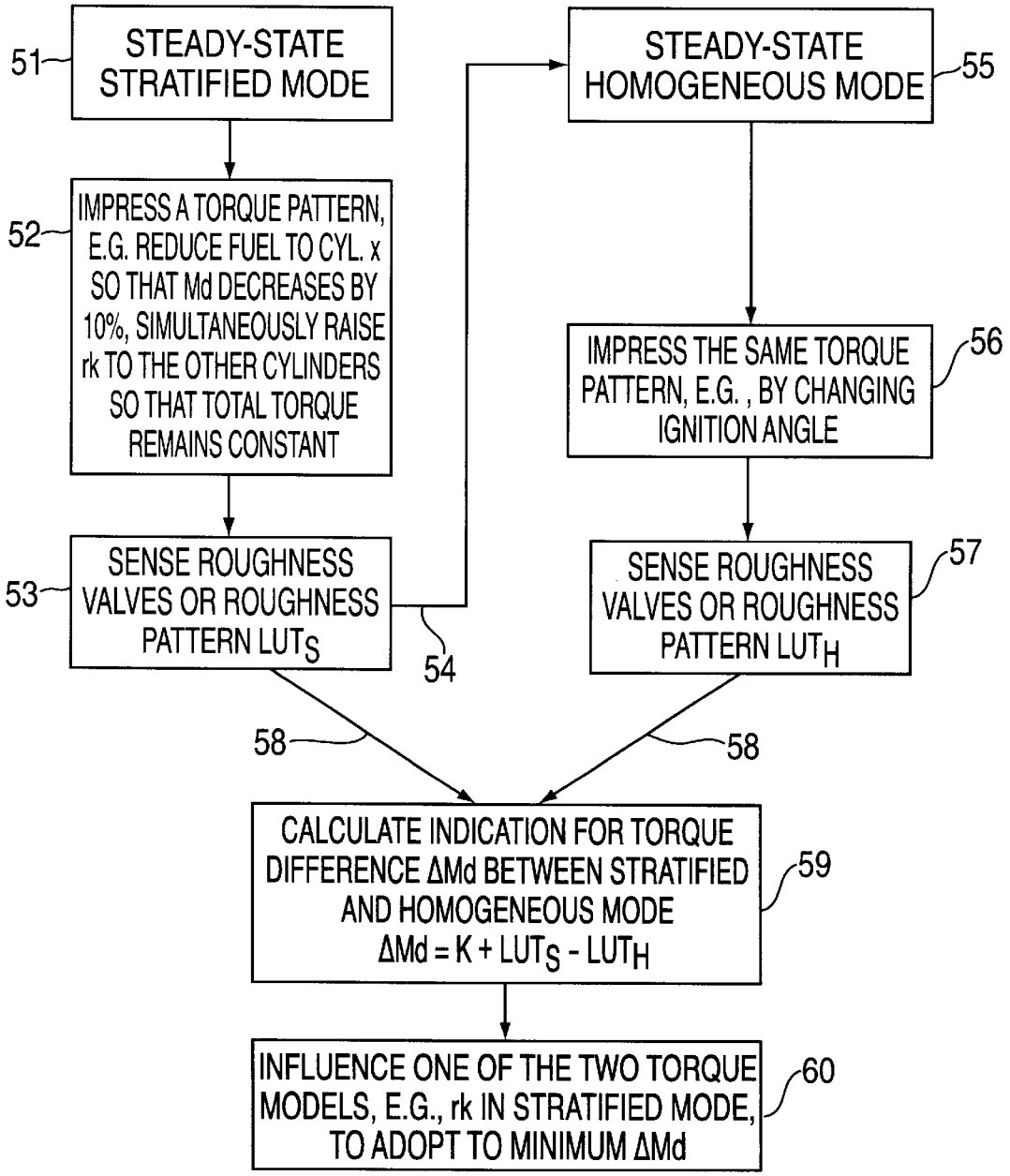
FIG. 5 shows a schematic flow chart of an exemplary embodiment of a method according to the present invention for switching over as defined in FIGS. 2 and 4.

FIG. 5 depicts a method that can be used during the switchover operation from stratified mode into homogeneous mode as shown in FIGS. 2 and 3. The purpose of the method is to detect changes in the torque of internal combustion engine 1, i.e., changes in the delivered actual torque Md during the switchover operation. The blocks shown in FIG. 5 represent functions of the method that are implemented in control device 16, for example, in the form of software modules or the like.

In a block 51, execution begins from a steady-state stratified mode in which internal combustion engine 1 is operating, and in which internal combustion engine 1 has a specific operating point that can be perceived by control device 16.

At this stratified-mode operating point, in a block 52 a reduction in fuel mass rk supplied to cylinder x is performed in such a way that actual torque Md of the internal combustion engine would of itself decrease by, for example, 10%. At the same time, however, fuel mass rk supplied to the other cylinders is increased in such a way that actual torque Md of internal combustion engine 1 would increase by 10%. The overall result of this is that actual torque Md of internal combustion engine 1 does not change, i.e., the total torque of all the cylinders remains approximately constant. In this fashion, internal combustion engine 1 thus has impressed onto it a so-called torque pattern which on the one hand causes a change in the delivered torque of the individual cylinder 3 but globally does not change the total torque of all the cylinders 3.

It is expressly noted that other possibilities for influencing internal combustion engine 1 are also possible. What is essential is that the delivered torques of successive cylinders are modified.

In a block 53, roughness values of the individual cylinders 3 are then determined. By analogy with the torque pattern, this is a so-called roughness pattern.

These roughness values can be any values that characterize the roughness or smoothness of internal combustion engine 1. For example, it is possible to associate with internal combustion engine 1 a sensor that senses the roughness or smoothness of internal combustion engine 1. It is also possible to determine the roughness of internal combustion engine 1 from other operating variables, in particular those already available, of internal combustion engine 1. In particular, it is possible to calculate the roughness from rotation speed N of internal combustion engine 1.

The roughness or smoothness of internal combustion engine 1 represents an indication of changes in actual torque Md of internal combustion engine 1. In particular, the roughness or smoothness represents an indication of torque differences between successively fired cylinders 3 of internal combustion engine 1. For this purpose, it is possible for the roughness or smoothness to be associated with the individual cylinders 3 of internal combustion engine 1.

A method for determining the roughness or smoothness of internal combustion engine 1 is explained below. It is explicitly noted here that this method that is described is of an exemplary nature only, and can be replaced and/or complemented by any other methods for determining roughness or smoothness.

To determine the roughness of internal combustion engine 1, segment times ts are measured during operation of internal combustion engine 1, a segment time ts being measured at each combustion event. Each combustion event receives a number n, and the associated segment time is correspondingly labeled ts(n). A segment is defined, for example, as a crankshaft angle of 360 degrees divided by half the number of cylinders, and is allocated to each of cylinders 3 of internal combustion engine 1. In particular, it is possible to allocate the segment symmetrically with respect to the top dead center point of the particular cylinder 3.

The combustion-dependent segment times ts(n) are sensed, for example, with the aid of a sensor that measures the time required for the particular segment to move past a reference point. The sensor can be, in particular, rotation speed sensor 15. The segment times ts(n) measured by the sensor simultaneously represent rotation speed data from which the rotation speed profile, and thus also rotation speed fluctuations, can be derived for the particular cylinder 3.

By way of comparison functions and (optionally) adaptation functions, it is possible to determine system-related rotation speed fluctuations and either compensate for them or leave them out of consideration in calculating the roughness. These can be, for example, production tolerances or vibrations or the like. Compensated segment times tsk(n) of this kind are thus substantially dependent only on individual-cylinder torque fluctuations.

The roughness value is calculated from these compensated segment times tsk(n), for example, as follows:

$$\mathrm{lut}(n)=(\mathrm{tsk}(n+1)-\mathrm{tsk}(n)/\mathrm{tsk}(n)^3).$$

Allocating the roughness values lut(n)– sequentially numbered in accordance with the combustion events n– to the, for example, z cylinders 3 of internal combustion engine 1 yields individual-cylinder roughness values lut(z,j) for each working cycle j. These roughness values lut(z,j) can be filtered using corresponding algorithms. For example, it is possible to perform a low-pass filtration operation in order to suppress stochastic interference. Individual-cylinder roughness values flut(z,j) filtered in this fashion represent the aforesaid indication of torque differences between successively fired cylinders 3 of internal combustion engine 1.

Once roughness values lut(n) and/or lut(z,j) and/or flut (z,j) have been determined in block 53, for example using the method described, these values are reused in the method described below. As already mentioned, however, roughness values determined in other ways can also be correspondingly used in the method described below.

The roughness values ultimately used refer, as mentioned, to a specific stratified-mode operating point, and are therefore labeled $LUT_S$ in FIG. 5.

At a later point in time, internal combustion engine 1 is at a homogeneous-mode operating point corresponding to the aforesaid stratified-mode operating point. This fact is detected by control device 16, as indicated in FIG. 5 by arrow 54. In block 55, internal combustion engine 1 is thus at the aforesaid corresponding steady-state homogeneous-mode operating point.

If this is the case, then in a block 56, the same torque pattern that was impressed at the corresponding steady-state stratified-mode operating point in block 52 is impressed onto internal combustion engine 1. Whereas in block 52 fuel mass rk was adjusted for this purpose, in block 56 ignition angle ZW or the ignition time can now be modified for the purpose.

Roughness values of the individual cylinders 3 are determined in block 57. By analogy with the torque pattern, these are so-called roughness patterns.

These roughness values are determined in the same fashion as has already been explained in conjunction with block 53. Once roughness values lut(n) and/or lut(z,j) and/or flut(z,j) have been determined, these values are reused in the method described below. As already mentioned, however, roughness values determined in other ways can also be correspondingly used in the method described below.

The roughness values ultimately used refer, as mentioned, to a specific homogeneous-mode operating point and are therefore labeled $LUT_H$ in FIG. 5.

The determination of roughness values $LUT_S$ and $LUT_H$ can also be accomplished in reverse order, so that execution proceeds first through blocks 55, 56, and 57 and only then through blocks 51, 52, and 53. In this case arrow 54 extends from the output of block 57 to the input of block 51.

Once roughness values $LUT_S$ and $LUT_H$ are available, the method continues with a block 59. This is indicated by the two arrows 58.

In block 59, an indication for a torque difference ΔMd is determined from the two roughness values $LUT_S$ and $LUT_H$. This is explained below with reference to FIG. 6.

Figure 6:
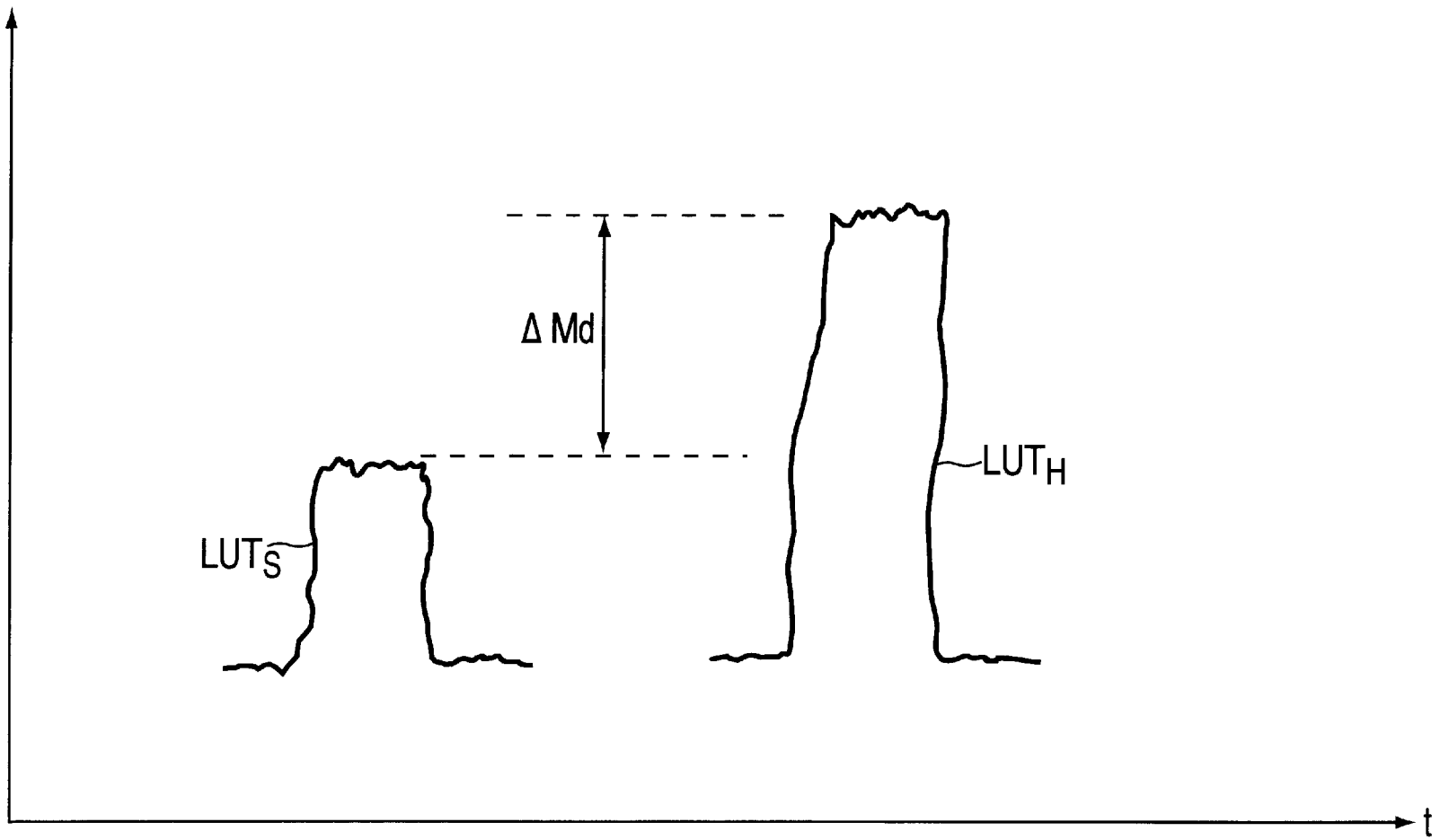
FIG. 6 shows a schematic time diagram of roughness values of a cylinder of the internal combustion engine of FIG. 1.

FIG. 6 depicts a time diagram for the two roughness values $LUT_S$ and $LUT_H$ of a cylinder 3. It is evident that roughness value $LUT_S$ is different in terms of magnitude from roughness value $LUT_H$. This difference is based on different torques generated by internal combustion engine 1 at the mutually corresponding operating points in stratified mode and in homogeneous mode. The difference thus represents an indication of torque difference ΔMd between the two operating modes, as expressed by:

$$\Delta\mathrm{Md}=k*(\mathrm{LUT}_S-\mathrm{LUT}_H)$$

where k is an internal combustion engine-dependent proportionality factor.

Torque difference ΔMd is determined in block 59 by control device 16. It is optionally necessary in this context to take into account further operating variables of internal combustion engine 1. It is also optionally necessary to adapt this calculation over the operating lifetime of internal combustion engine 1.

In a subsequent block 60, internal combustion engine 1 is influenced in such a way that torque difference ΔMd becomes as small as possible or in fact zero. In other words, the operating variables of internal combustion engine 1 are modified in such a way that torque difference ΔMd becomes smaller.

For that purpose, the operating variables are influenced in one of the two operating modes or optionally also in both operating modes. In stratified mode, for example, fuel mass rk supplied to combustion chamber 4 can be modified. In homogeneous mode, for example, the retarding of ignition angle ZW or of the ignition time can be modified.

Once the method of FIG. 5 has been used to detect changes in actual torque Md of internal combustion engine 1, i.e., torque differences ΔMd, during the switchover operation, then countermeasures are initiated in block 60, as described. These countermeasures are changes in the operating variables of internal combustion engine 1 with which actual torque Md of internal combustion engine 1 is influenced.

If changes in torque between regions A and D are ascertained, then in region A, fuel mass rk to be injected into combustion chamber 4 is decreased or increased in such a way that the ascertained torque changes become smaller. It is also alternatively or additionally possible, if torque changes between regions A and D are ascertained in homogeneous mode, to adjust air mass rl and/or fuel mass rk and/or optionally ignition angle ZW or the ignition time in such a way that the torque changes are reduced. The torque changes ascertained between regions A and D are static torque changes that can be permanently corrected by adaptive changes in the respectively aforementioned operating variables.

In the case of a switchover operation from homogeneous operation to stratified operation as depicted in FIG. 4, if torque changes are ascertained in regions A and D, air mass rl or the charge and/or fuel mass rk are adjusted so that the torque changes are reduced. It is additionally or alternatively possible, if torque changes are ascertained in regions A and D, to decrease or increase fuel mass rk to be injected into combustion chamber 4 in such a way that the ascertained torque changes become smaller. The torque changes ascertained between regions A and D are static torque changes that can be permanently corrected by adaptive changes in the respectively aforementioned operating variables.

The aforesaid influences on operating variables of internal combustion engine 1 in order to compensate for roughness or jerking during a switchover operation can be exerted immediately, so that optionally an effect occurs even during the current switchover operation. It is also possible, however, for the influences to be exerted in such a way that an effect is present only at the next switchover operation.

In the case of adaptive actions, it is possible for the operating variables of the respective operating mode to be modified on the basis of a single determination of torque change ΔMd for a specific operating point. It is also possible to utilize for this purpose torque changes from several operating points or even from all operating points.

What is claimed is:

1. A method for operating an internal combustion engine of a motor vehicle, comprising:

directly injecting fuel into a combustion chamber of the internal combustion engine during a compression phase in a first operating mode, and during an intake phase in a second operating mode;

switching between the first operating mode and the second operating mode;

controlling operating variables influencing an actual torque of the internal combustion engine as a function of a reference torque, the operating variables being controlled differently for each of the first operating mode and the second operating mode;

detecting a change in the actual torque during the switching step; and influencing at least one of the operating variables as a function of the detected change.

2. The method according to claim 1, further comprising:

determining the actual torque before and after the switching step.

3. The method according to claim 1, wherein the detecting step includes detecting the change in the actual torque as a function of a sensed rotation speed of the internal combustion engine.

4. The method according to claim 1, further comprising:

determining roughness values for individual cylinders of the internal combustion engine.

5. The method according to claim 4, further comprising:

changing the at least one of the operating variables in both the first operating mode and the second operating mode at a mutually corresponding operating point of the internal combustion engine; and comparing at least one of the roughness values of the first operating mode to at least one of the roughness values of the second operating mode.

6. The method according to claim 5, further comprising:

changing the at least one of the operating variables in a cylinder specific fashion so that a delivered torque of successive cylinders changes and a total torque of all of the cylinders remains the same.

7. The method according to claim 6, further comprising:

reducing the torque delivered by one of the cylinders so that torques delivered by others of the cylinders are increased proportionally.

8. The method according to claim 4, wherein the determining the roughness values step includes the step of determining the roughness values in each of the first operating mode and the second operating mode, the method further comprising:

comparing the roughness values determined in the first operating mode with the roughness values determined in the second operating mode.

9. The method according to claim 8, further comprising:

determining a torque difference as a function of the comparison of the roughness values.

10. The method according to claim 8, wherein the influencing step includes influencing the at least one of the operating variables as a function of the comparison of the roughness values.

11. The method according to claim 1, wherein the influencing step includes adaptively influencing the at least one of the operating variables.

12. The method according to claim 1, further comprising:

adaptively adjusting calculation modes of the first operating mode and the second operating mode to one another.

13. The method according to claim 1, further comprising:

influencing another of the operating variables after a next switching step.

14. The method according to claim 1, further comprising:

increasing an injected fuel mass in the first operating mode.

15. The method according to claim 1, further comprising:

influencing at least one of an air mass and a fuel mass in the second operating mode.

16. A read-only memory for a control device of an internal combustion engine of a motor vehicle, the memory storing a program that is executable by a processor for causing the internal combustion engine to perform a method of operation, the method comprising the steps of:

directly injecting fuel into a combustion chamber of the internal combustion engine during a compression phase in a first operating mode, and during an intake phase in a second operating mode;

switching between the first operating mode and the second operating mode;

controlling operating variables influencing an actual torque of the internal combustion engine as a function of a reference torque, the operating variables being controlled differently for each of the first operating mode and the second operating mode;

detecting a change in the actual torque during the switching step; and influencing at least one of the operating variables as a function of the detected change.

17. An internal combustion engine for a motor vehicle, comprising:

a fuel injection valve injecting fuel directly into a combustion chamber of the engine during a compression phase in a first operating mode, and during an intake phase in a second operating mode; and a control device for switching between the first operating mode and the second operating mode, operating variables influencing an actual torque of the internal combustion engine being controlled differently for the first operating mode and the second operating mode as a function of a reference torque, the control device detecting a change in the actual torque during the switching operation and influencing at least one of the operating variables as a function of the detected change.

* * * * *